United States Patent [19]

Sumida

[11] Patent Number: 4,881,101

[45] Date of Patent: Nov. 14, 1989

[54] DEVICE FOR SETTING OPERATION MODES OF OFFICE EQUIPMENT

[75] Inventor: Hiroyasu Sumida, Ichikawa, Japan

[73] Assignee: Ricoh Company, Ltd., Tokyo, Japan

[21] Appl. No.: 269,059

[22] Filed: Nov. 9, 1988

[30] Foreign Application Priority Data

Nov. 10, 1987 [JP] Japan ..... 62-283873

[51] Int. Cl.[4] ..... G03G 15/00

[52] U.S. Cl. ..... 355/204; 355/209; 364/160; 364/172; 364/300

[58] Field of Search ..... 355/204, 209; 364/138, 364/141, 146, 147, 160, 172, 191, 300, 900

[56] References Cited

U.S. PATENT DOCUMENTS

| | | | |
|---|---|---|---|
| 4,196,476 | 4/1980 | Steiner | 364/900 |
| 4,305,654 | 12/1981 | Shimizu et al. | 355/204 |
| 4,314,334 | 2/1982 | Daughton et al. | 355/204 X |
| 4,453,821 | 6/1984 | Smith | 355/204 X |
| 4,699,501 | 10/1987 | Watanabe et al. | 355/204 X |

*Primary Examiner*—A. C. Prescott

*Attorney, Agent, or Firm*—Oblon, Spivak, McClelland,Maier & Neustadt

[57] ABSTRACT

A mode setting device for an electrophotographic copier or similar office machine of the type having a machine body, a housing, an openable cover forming a part of the housing, and a power supply which is turned on and off in interlocked relation to the opening and closing of the cover member. The device includes a mode preservation commanding switch and a non-volatile memory which stores operation modes of the machine having been selected before the turn-off of the power supply. When the power supply is turned off after the commanding switch has been turned on and then turned on again, the operation modes of the machine stored in the non-volatile memory are automatically set up again. When the commanding switch is turned off, the operation modes of the machine are initialized as soon as the power source is turned on again. The need for manipulations otherwise required for re-setting operation modes due to opening and closing of the cover member is eliminated.

8 Claims, 5 Drawing Sheets

DEVICE FOR SETTING OPERATION MODES OF OFFICE EQUIPMENT

BACKGROUND OF THE INVENTION

The present invention relates to an electrophotographic copier, facsimile apparatus, printer or similar office equipment having a power supply and, more particularly, to a device installed in such office equipment for setting operation modes immediately after the power supply has been turned on.

Today, offices are equipped with various kinds of machines such as a copier, a facsimile apparatus and a printer to enhance efficient business transactions. An electrophotographic copier, for example, adapted to transfer an image developed by toner to a paper sheet is provided with a cover or door at its front end to facilitate the removal of a jamming sheet and maintenance. When the front cover is opened, major parts and elements of mechanical sections of the copier are uncovered. Since mechanically operated sections and sections powered by high voltages are disposed inside of the cover, an interlock switch interlocked with the opening and closing motions of the door is provided to eliminate hazards ascribable to those sections. The power supply of the copier is automatically shut off when the door is opened.

The electrophotographic copier or similar office machine has various functions and is provided with an operation board which is accessible for selectively using the functions, i.e., for entering commands to set up desired operation modes. Upon turn-on of the power supply, the machine is automatically initialized to set up the commonest operation modes. The operator of the machine may manipulate the operation board to replace the commonest modes with any other desired modes after turning on the power supply. When the cover is opened to make access to the interior of the copier for replacing a developing cartridge, checking a total copy counter or a paper transport path or similar purpose, the power supply is shut off by the interlock switch. When the cover is closed after the replacement or the check, the operation mode is initialized. More specifically, when the cover is opened, the power supply of the copier having been operated in modes other than the initial or commonest modes is turned off and, when the door is closed again, the operation modes are returned to the commonest ones. To restore the copier to the previous modes, the operator has to manipulate the operation board all over again. Nevertheless, shutting off the power supply when the cover is opened and initializing the operation modes upon the turn-on of the power supply are essential.

There has been proposed an implementation for inhibiting the operation modes from being initialized when the power supply is turned off when toner runs out or when a paper sheet jams the transport path. Such a prior art scheme, however, fails to preserve the particular operation modes except for those special occurrences, i.e., the operation modes have to be set again in the event of maintenance or similar ordinary work. In a copier with a programming function which is implemented by a memory, the initialization of the operation modes is prevented by backing up the memory constantly or by backing it up by an exclusive spare power supply only when a paper jam or similar trouble occurs and when the front door is open. A drawback with the constant back-up scheme is that when a power switch of the machine is turned on for the first time in the morning, an operation mode selected the day before appears as they are to puzzle the operator. On the other hand, the selective back-up scheme is disadvantageous in that an extra power supply for backing up is needed and in that extra and complicated means for sensing a paper jam and an open position of the door are indispensable. A non-volatile memory may be used to allow a person to register operation modes selected and, after the shut-off the power supply, to call them out of the memory by manipulating keys on the operation board. However, the manipulations for registering and calling the operation modes are complicated and therefore awkward.

SUMMARY OF THE INVENTION

It is therefore an object of the present invention to provide a device for setting operation modes of office equipment having a power supply when the power supply is turned on.

It is another object of the present invention to provide a device for preventing operation modes of a copier or similar office equipment from being initialized when a power supply of the equipment is turned off and on due to opening and closing of a front cover.

It is another object of the present invention to provide a generally improved device for setting operation modes of office equipment.

A device for setting operation modes of a machine having a machine body, a housing surrounding the machine body, and an openable cover member forming part of the housing, and driven by a power supply unit of the present invention comprises power supply shut-off means for shutting off at least a part of power supplies of the power source unit when the cover member is opened, a store for preserving data stored in the store even when the power supply of the machine is shut off by the power supply shut-off means, commanding means for commanding preservation of operation modes of the machine, and a control for controlling the power supply unit, store and commanding means. The control causes the store to store operation modes of the machine when the machine is being powered by the power supply unit, initializes, when a command from the commanding means is absent, the operation modes of the machine after the machine has been powered by the power supply unit, and restores, when the command from the commanding means is present, the machine to the operation modes stored in the store after the machine has been powered by the power supply unit.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
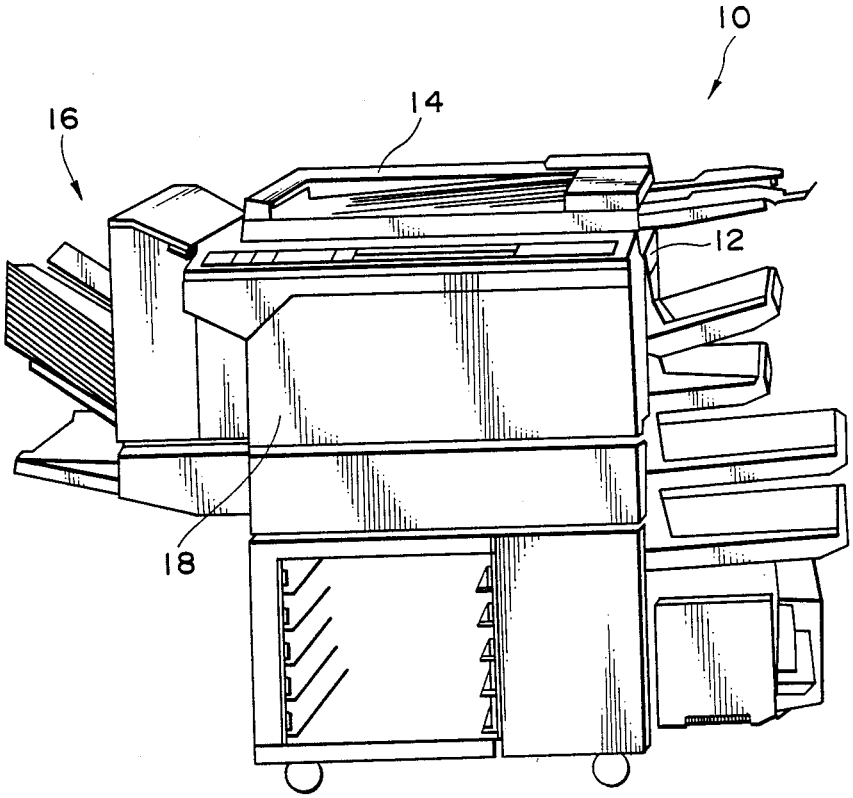
FIG. 1 is a front view showing an electrophotographic copier representative of office equipment to which the present invention is applicable.

Referring to FIG. 1 of the drawings, an electrophotographic copier to which the present invention is applied is shown and generally designated by the reference numeral 10. As shown, the copier 10 is generally comprised of a copier body 12 and various optional units such as an ADF (Automatic Document Feeder) 14, a sorter 16, and an automatic two-side processing unit. A front cover 18 is mounted on the front end of the copier body 12. The cover 18 is hinged at its lower end to a frame member of the copier body 12 and retained at a part of its upper end by a magnetic retaining implement (not shown) on the cover 18. When the cover 18 is pulled toward the operator, it is rotated about a hinge (not shown) so that various mechanical parts and elements disposed in the copier body 12 show themselves.

Figure 2:
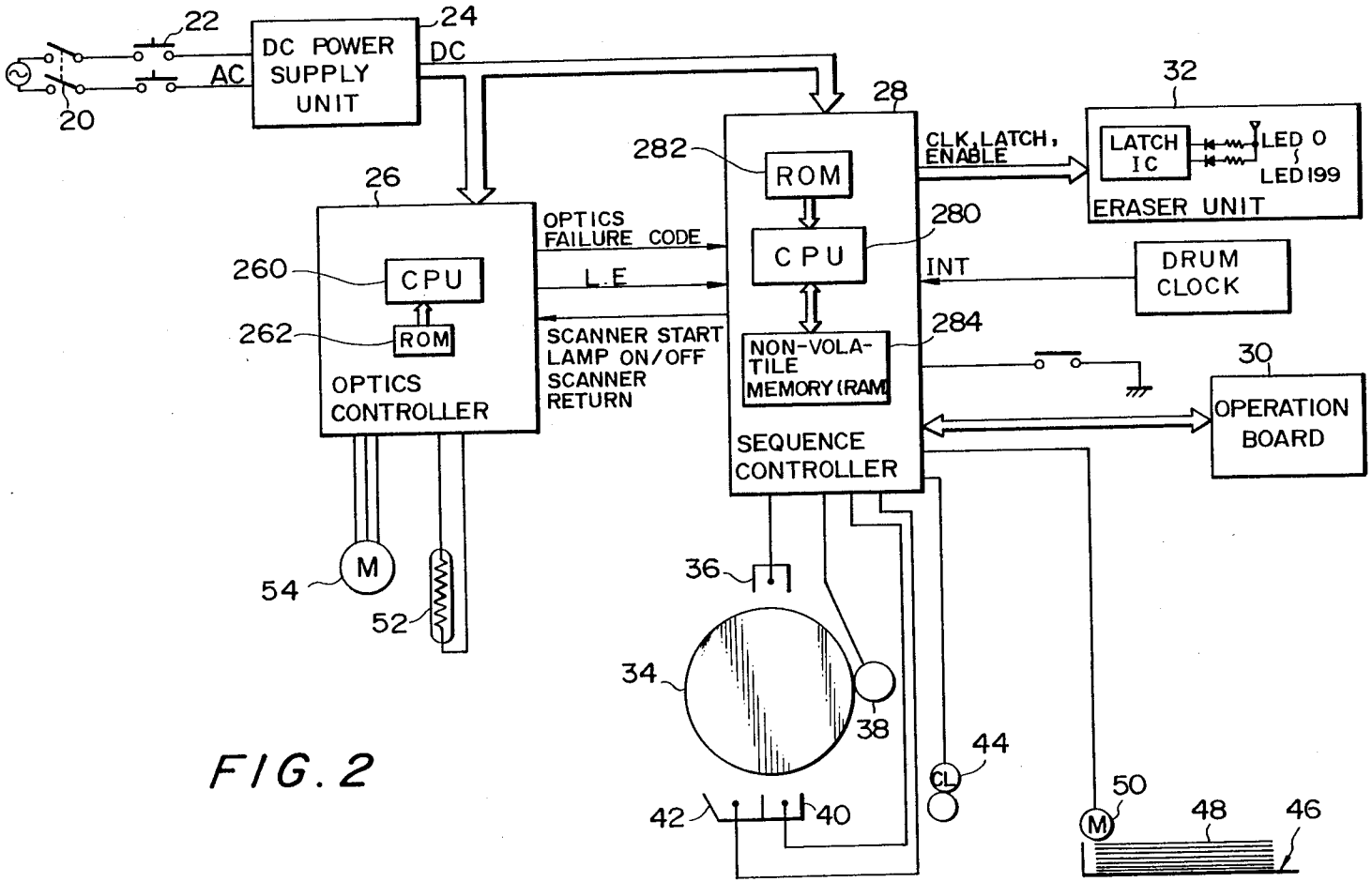
FIG. 2 is a schematic block diagram of an operation mode setting device embodying the present invention which is installed in the copier of FIG. 1.

Referring to FIG. 2, an operation mode setting device embodying the present invention and which is installed in the copier body 12 is shown. In the figure, a commercial power supply (AC 100 volts) is connected to a DC power supply unit 24 via a main switch 20 and an interlock switch 22. Interlocked with the front cover 18, the interlock switch 22 is closed when the cover 18 is closed and opened when the cover 18 is opened. Therefore, when the cover 18 is opened, the power supply of the DC power supply unit 24 is shut off. Various DC voltages outputted by the DC power supply unit 24 are fed to an optics controller 26, a sequence controller 28, an operation board 30, an eraser unit 32, etc. The optics controller 26 is made up of a microprocessor 260 and a read only memory (ROM) 262. Constituting a microcomputer system, the sequence controller 28 includes a microprocessor 280, a ROM 282, and a non-volatile random access memory (RAM) 284. The RAM 284 is constructed by adding a battery back-up circuit to an ordinary RAM. A photoconductive element 34 in the form of a drum serves as an image carrier, as well known in the art. Connected to the sequence controller 28 are a main charger 36 implemented by a corona charger, a developing roller 38, a transfer charger 40, a separation charger 42, a register clutch 44, a paper feed section 46 for feeding paper sheets 48, and a motor 50 associated with the paper feed section 46. Connected to the optics controller 26 are a lamp 52 and a motor 54 adapted to drive a scanner of the copier 10.

Figure 3:
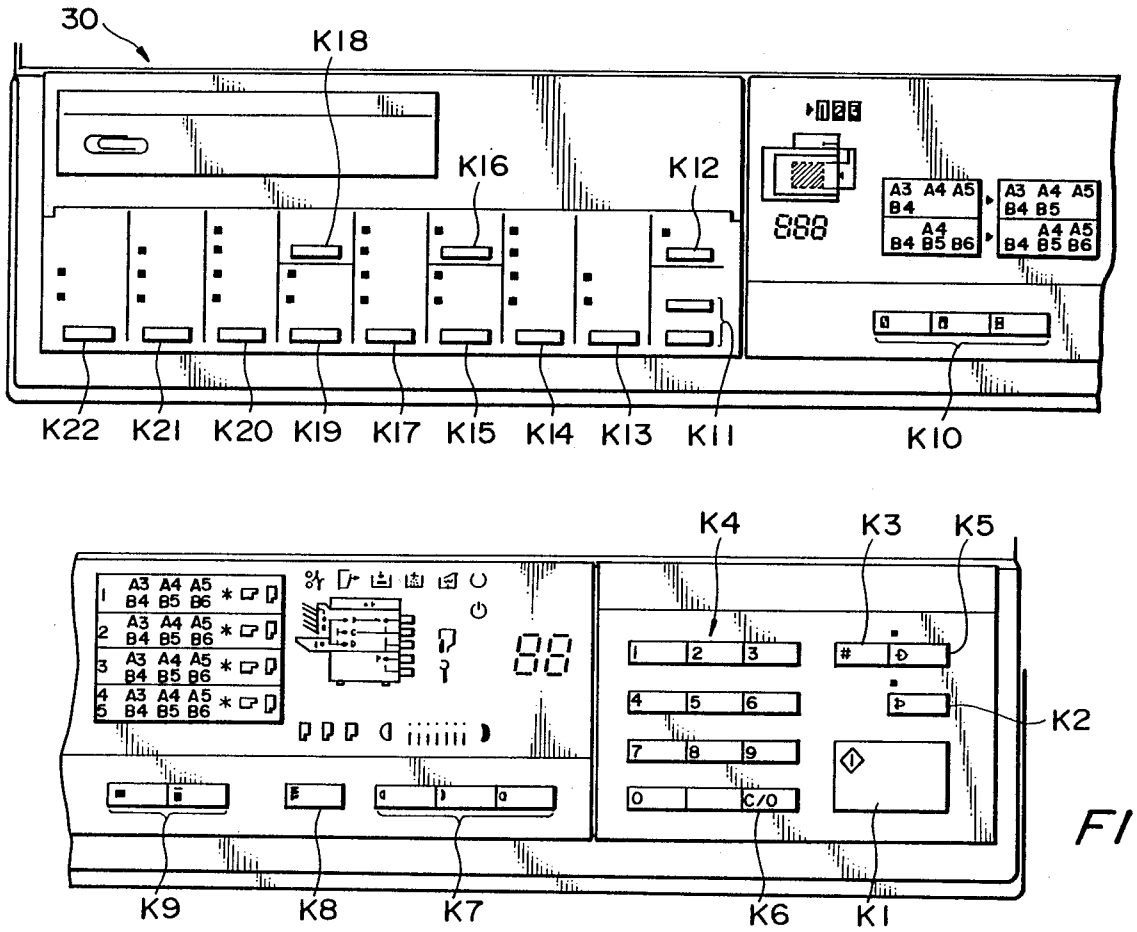
FIG. 3 is a plan view showing an operation board of the copier shown in FIG. 1.

FIG. 3 shows the operation board 30 of the copier 10 in a plan view. As shown, a number of key switches and various kinds of indicators and displays are arranged on the operation board 30. Functions assigned to the key switches will be outlined hereinafter.

K1: a print key for commanding a copy start

K2: a key for selectively commanding mode clearing and preheating. When the key K2 is pressed for a short time, it restores various modes selected on the operation board 30 to basic modes which hold in the event of turn-on of the power supply; when it is pressed for a substantial period of time such as 1 second, the key K2 brings the machine into a preheat mode in which the fixing temperature is lowered and the machine is maintained in a standby condition. Pressing the key K2 again will cancel the preheat mode and, instead, set up modes in which the copier 10 is ready to operate.

K3: a key available for confirming a numerical value and entering data

K4: keys representative of numerals 0 to 9, i.e., ten keys available for entering a numerical value such as the desired number of copies or data particular to the machine K5: a memory key for storing operation modes and operable to preserve operation modes temporarily and to register operation modes in a program K6: a key for clearing entered values if the machine is not operating and stopping a copying operation if it is operating in a continuous mode K7: keys accessible for adjusting copy density. When an automatic density control key is pressed, the lamp voltage, developing bias, drum charge and the like are automatically adjusted to their optimum values on the basis of an output of a document density sensor. A "dark" key and a "light" key are available for selecting particular density to the operator's taste.

K8: a key for designating a particular developing unit to be used. The copier 10 is assumed to be selectively operable with a developer containing black toner and a developer containing color toner which are replaceable by opening the front cover 18. Control parameters are changed depending upon the kind of toner selected.

K9: keys for selecting one of a plurality of, five in this example, paper feed sections 46 adapted to feed paper sheets 48

K10: keys for selecting and adjusting a magnification out of predetermined steps K11: keys for adjusting the magnification on a 1 percent basis K12: a key for selecting a mode which automatically sets up a magnification matching with a document size and a paper size K13: a key for selecting a mode which automatically sets up a magnification matching with a document size and an image size to be reproduced which may be entered on the operation board 30

K14: key for selecting a combination mode. In this example, four different combination modes are available:

(a) a simple combination mode in which two different documents are transferred to a single paper sheet 48 one upon the other by two consecutive operations;

(b) an outside-color combination mode in which dimensions of a portion which is marked by a box are entered, the inside of the box is developed in black and transferred to a paper sheet 48, and the outside of the box is developed in color and transferred to the same paper sheet 48 to thereby produce a composite image;

(c) an inside-color combination mode in which the outside of a box-like marked area is developed in black and transferred to a paper sheet 48 and, then, the inside of the marked area is developed in color and transferred to the same paper sheet 48; and (d) an undercolor mode in which the inside of a marked box is entirely developed in color and transferred and, then, a document image is developed in black and transferred onto such a solid area.

K15: a key available for selecting a page-continuous combination mode in which the right and left halves of a document which is laid in an opened position on a glass platen are reproduced on a single paper sheet 48. This combination mode includes two different submodes: a monocolor page-continuous submode for reproducing the right and left halves of a document in the same color, and a black and color page-continuous submode for developing one of the opposite halves in black and the other in color.

K16: a key for centering. In this example, a document size centering mode and an area centering mode are available. The document size centering mode is such that the size of a document is sensed by the optics, and a paper sheet 48 and an image on the drum 34 are so controlled with respect to timing as to align the center of the paper sheet 48 and the center of the document. On the other hand, the area centering mode is such that, when an outside erase mode is selected, a particular area of a document to be reproduced is determined on the basis of the entered dimensions and the center of this area is caused into alignment with the center of a paper sheet 48 selected.

K17: an erase key operable to set up an inside erase mode when it is desired to erase the inside of a marked area entered on the numeral keys and an outside erase mode when it is desired to erase the outside of the same area.

K18: a key for adjusting the binding margin of reproductions.

K19: a key for selecting a tone mode. In this example, two different modes are available: a red erase mode in which a red filter is inserted in an optical path of the image forming system to cut a red component, and a photograph mode in which the charges and the amount of exposure included in the image forming procedure are adjusted for soft development to thereby enhance the reproducibility of halftone.

K20: a page continue key. In this example, the key K20 is operable to select three different modes: a two-side document page continuation mode in which the ADF 14 having an automatic reversing capability is used to reproduce each of the opposite surfaces of a single document on a different paper sheet, a continuous copy magnification mode in which two different documents are individually reproduced in the former half and the latter half of a single paper sheet 48 while the magnification is automatically adjusted to reduce the size of each document to one half of the size of the sheet 48, and a open document page continuation mode in which the right page and the left page of an opened document are individually reproduced on different paper sheets 48.

K21: a key for selecting two-side processing. In this example, there are available a one side-to-two side copy mode for reproducing two one-sided documents on opposite surfaces of a single paper sheet 48, a two side-to-two side copy mode for reproducing a two-side document on opposite sides of a single paper sheet 48 as it is, and an opened document two side mode for reproducing the right half and the left half of an opened document on opposite surfaces of a single paper sheet 48.

K22: a key for selecting an operation mode of the sorter 16, i.e., a sort mode or a stack mode.

A different indicator or display is associated with each of the keys of the operation board 30 the functions of which have been described above. For example, an indicator implemented by a light emitting diode is associated with each of the keys K14 to K22 while a 7-segment numerical display is associated with each of the magnification key and ten keys. Concerning software for controlling the individual modes, a 1-bit flag is allocated to each of the modes which are individually associated with the indicators, and data to be displayed on each 7-segment display are stored in a 16-bit memory.

Operation mode data registers defined by a part of the non-volatile memory within the sequence controller 28 are shown in a memory map in Table 1 below.

TABLE 1

| ADDRESS | LABEL | BIT (LABEL) B7 | B6 | B5 | B4 | B3 | B2 | B1 | B0 |
|---|---|---|---|---|---|---|---|---|---|
| C040 | FGDSP4 | IAE | IRVSF | IRVS | IAEF | | IJOB | IOPL | IINT |
| C041 | FGDSP5 | IJAMM | IDOP | ITED | ITOVR | IKCT | IMNL | IPED | ISVM |
| C042 | FGDSP6 | IRDY | IWAT | ITEDF | ITOVRF | | | ISZCK | ICHEK |
| C043 | FGDSP7 | IJADF | IJAMS | IJAMF | IJAME | IJAMD | IJAMC | IJAMB | IJAMA |
| C044 | FGDSP8 | IJADFX | IJAMSX | IJAMFX | IJAMEX | IJAMDX | IJAMCX | IJAMBX | IJAMAX |
| C045 | FGDSP9 | ISTAK | ISORT | ICOPY | IADF | ISAD | | IPSIZ | IOSIZ |
| C046 | FGDSPA | | | IPEGUF | IPEGOF | IPEGU | IPEGO | IAPS | IAMS |
| C047 | FGDSPB | | | IDPXX6 | IDPXX5 | IDPXX4 | IDPXX3 | IDPXX2 | IDPXX1 |
| C048 | FGDSPC | IMASK | ITRIM | IFRM | ICENTE | ICENT | | | |
| C049 | FGDSPD | IUDC | IINC | IOUTC | I1CMP | | | | |
| C04A | DBDCNL | | | | | | | | |
| C04B | DBDCNH | | | | | | | | |
| C04C | DBDMGL | | | | | | | | |
| C04D | DBDMGH | | | | | | | | |

In Table 1, addresses C04A and C04B having two bytes constitute a 16-bit register for storing the number of copies entered on the ten keys K4. Addresses C04C and C04D having two bytes are a 16-bit register available for the display of a magnification. The content of the addresses C04C and C04D, for example, are updated every time the magnification key K10, K11, K12 or K13 is operated. Assigned to the addresses C040 to C049 are a number of flags each being associated with the on/off of a different indicator, i.e., a different operation mode. For example, when the undercolor mode is selected, a flag IUDC allocated to the most significant bit (B7) of the address C049 which is represented by a label FGDSPD is set with the result that FGDSPD becomes "10000000" in binary notation. When the stack mode which is one of the modes available with the sorter is selected, a flag ISTAK of a bit No. 7 of the address C045 which is represented by a label FGDSP9 is set. When the automatic density control mode is selected, a flag IAE of a bit No. 7 of the address C040 which is represented by a label FGDSP4 is set. Further, when the centering mode is selected, a flag ICENT allocated to a bit No. 3 of the address C048 which is represented by a label FGDSPC is set.

The statuses of the various memories shown in Table 1 in the initial condition, i.e., immediately after the turn-on of the power supply are shown in Table 2 below.

TABLE 2

| LABEL (ADDRESS) | BIT 7 | 6 | 5 | 4 | 3 | 2 | 1 | 0 |
|---|---|---|---|---|---|---|---|---|
| FGDSP4 | 1 | 0 | 0 | 0 | 0 | 0 | 0 | 0 |
| FGDSP5 | 0 | 0 | 0 | 0 | 0 | 0 | 0 | 0 |

TABLE 2-continued

| LABEL (ADDRESS) | BIT 7 | 6 | 5 | 4 | 3 | 2 | 1 | 0 |
|---|---|---|---|---|---|---|---|---|
| FGDSP6 | 0 | 0 | 0 | 0 | 0 | 0 | 0 | 0 |
| FGDSP7 | 0 | 0 | 0 | 0 | 0 | 0 | 0 | 0 |
| FGDSP8 | 0 | 0 | 0 | 0 | 0 | 0 | 0 | 0 |
| FGDSP9 | 0 | 0 | 0 | 0 | 0 | 0 | 0 | 0 |
| FGDSPA | 0 | 0 | 0 | 0 | 0 | 0 | 1 | 0 |
| FGDSPB | 0 | 0 | 0 | 0 | 0 | 0 | 0 | 0 |
| FGDSPC | 0 | 0 | 0 | 0 | 0 | 0 | 0 | 0 |
| FGDSPD | 0 | 0 | 0 | 0 | 0 | 0 | 0 | 0 |
| DBDCNL | 0 | 0 | 0 | 0 | 0 | 0 | 0 | 1 |
| DBDCNH | 0 | 0 | 0 | 0 | 0 | 0 | 0 | 0 |
| DBDMGL | 0 | 1 | 1 | 0 | 0 | 1 | 0 | 0 |
| DBDMGH | 0 | 0 | 0 | 0 | 0 | 0 | 0 | 0 |

Table 3 shown below lists the contents of the memories which are associated with an exemplary case wherein in the initial condition the undercolor mode is selected, the stack mode is selected for the operation mode of the sorter 16, the automatic density control mode is selected, and the centering mode is selected.

TABLE 3

| LABEL (ADDRESS) | BIT 7 | 6 | 5 | 4 | 3 | 2 | 1 | 0 |
|---|---|---|---|---|---|---|---|---|
| FGDSP4 | 1 | 0 | 0 | 0 | 0 | 0 | 0 | 0 |
| FGDSP5 | 0 | 0 | 0 | 0 | 0 | 0 | 0 | 0 |
| FGDSP6 | 1 | 0 | 0 | 0 | 0 | 0 | 0 | 0 |
| FGDSP7 | 0 | 0 | 0 | 0 | 0 | 0 | 0 | 0 |
| FGDSP8 | 0 | 0 | 0 | 0 | 0 | 0 | 0 | 0 |
| FGDSP9 | 1 | 0 | 0 | 0 | 0 | 0 | 0 | 0 |
| FGDSPA | 0 | 0 | 0 | 0 | 0 | 0 | 0 | 0 |
| FGDSPB | 0 | 0 | 0 | 0 | 0 | 0 | 0 | 0 |
| FGDSPC | 0 | 0 | 0 | 0 | 1 | 0 | 0 | 0 |
| FGDSPD | 1 | 0 | 0 | 0 | 0 | 0 | 0 | 0 |
| DBDCNL | 0 | 0 | 0 | 1 | 1 | 0 | 0 | 1 |
| DBDCNH | 0 | 0 | 0 | 0 | 0 | 0 | 0 | 0 |
| DBDMGL | 0 | 1 | 1 | 0 | 0 | 1 | 0 | 0 |
| DBDMGH | 0 | 0 | 0 | 0 | 0 | 0 | 0 | 0 |

The operation modes automatically set up in the initial condition of the copier 10 are the x1 magnification (100 percent), automatic density control mode, one copy which is the number of copies set, and automatic paper selection mode, the other operation modes which implement auxiliary functions being reset without exception. These modes in the initial condition are automatically set up by the initialization which the microprocessor 280 executes immediately after the turn-on of the power supply on the basis of initial data stored in the ROM 282 of the sequence controller 28 beforehand. However, the initialization of the modes immediately after the turn-on of the power supply is inhibited in a particular situation which will be described.

As previously stated, opening the front cover 18 of the copier 10 causes the interlock switch 22 to shut off the power supply. Since the registers (memories) listed in Table 1 are implemented by the non-volatile memory 284, data stored therein do not disappear even if the power supply is turned off due to opening of the cover 18. When the cover 18 is closed again after the replacement of a developing unit or similar operation, the interlock switch 22 is actuated to turn on the power supply again. At this time, the microprocessor 280 of the sequence controller 28 starts processing from the beginning of the program, i.e., address zero of the memories and therefore executes initialization. As a result, the contents of the register shown in Table 1 are replaced with the data shown in Table 2. For example, the developing unit is to be replaced for implementing a black mode or a color mode, it is necessary to open and close the front cover 18. However, if the various modes are initialized every time the cover 18 is opened, they have to be entered all over again every time the developing unit is replaced. In the illustrative embodiment, an arrangement is so made as to allow the initialization of the modes ascribable to the opening and closing of the door 18 to be inhibited by a simple manipulation. Specifically, the operator is capable of inhibiting the initialization of the memories ascribable to the opening of the cover 18 from its closed position and the subsequent closing of the same simply by pressing the memory key K5 on the operation board 30 before opening the cover 18.

Figure 4:
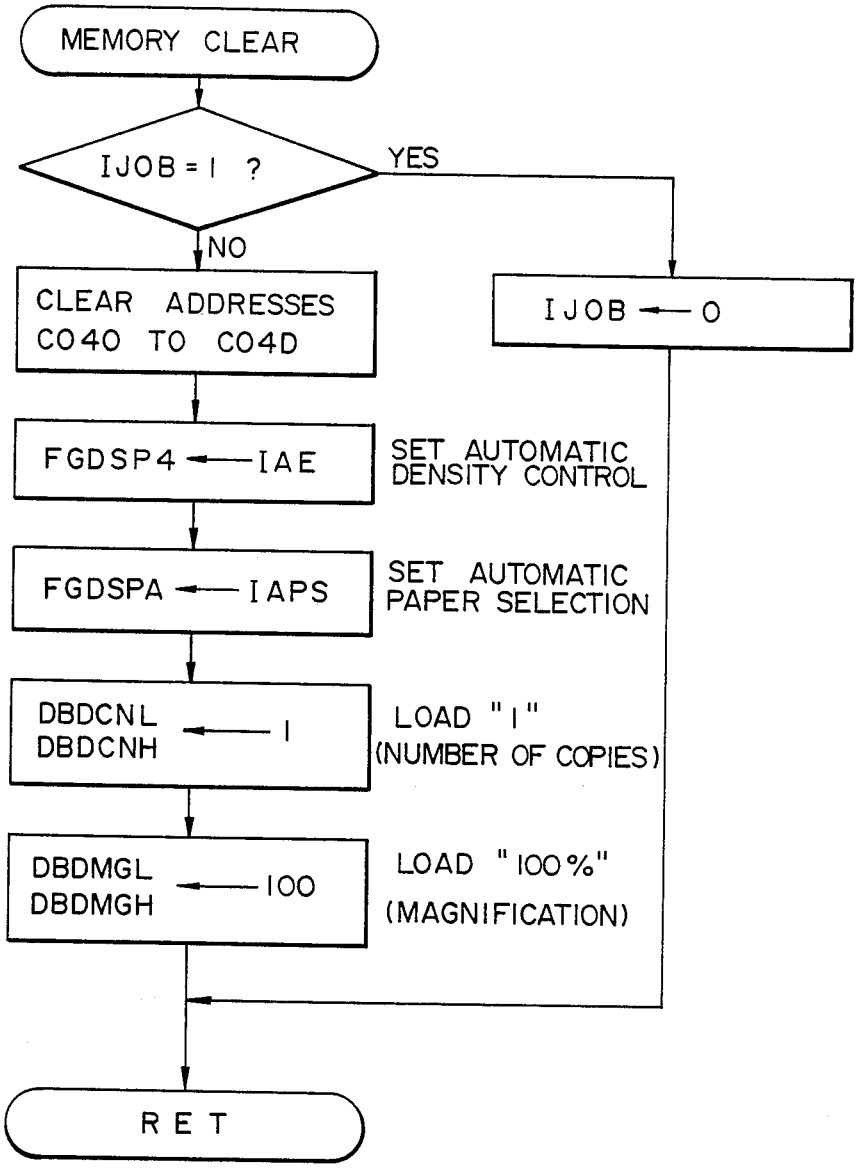
FIGS. 4 and 5 are flowcharts demonstrating specific operations of a microprocessor which is included in the circuitry of FIG. 2.

Referring to FIGS. 4 an 5, specific operations of the microprocessor 280 are shown. Specifically, FIG. 4 shows a memory clear subroutine which is executed immediately after the turn-on of the power supply while FIG. 5 shows a part of processing which is executed in response to a key input on the operation board 30.

In FIG. 4, a status of the flag IJOB assigned to the bit No. 2 of the address C040 which is represented by the label FGDSP4 is representative of memory clear allowed/inhibited. As shown in Table 2, the flag IJOB is a ZERO in the initial condition. Hence, when the memory clear subroutine is executed, there usually occurs a sequence of steps of writing a ZERO in all of the addresses C040 to C04D, setting the flag IAE of FGDSP4, setting the flag IAPS of FGDSPA, storing "1" in DBDCNL/DBDCNH, and storing "100" in DBDMGL/DBDMGH.

Figure 5:
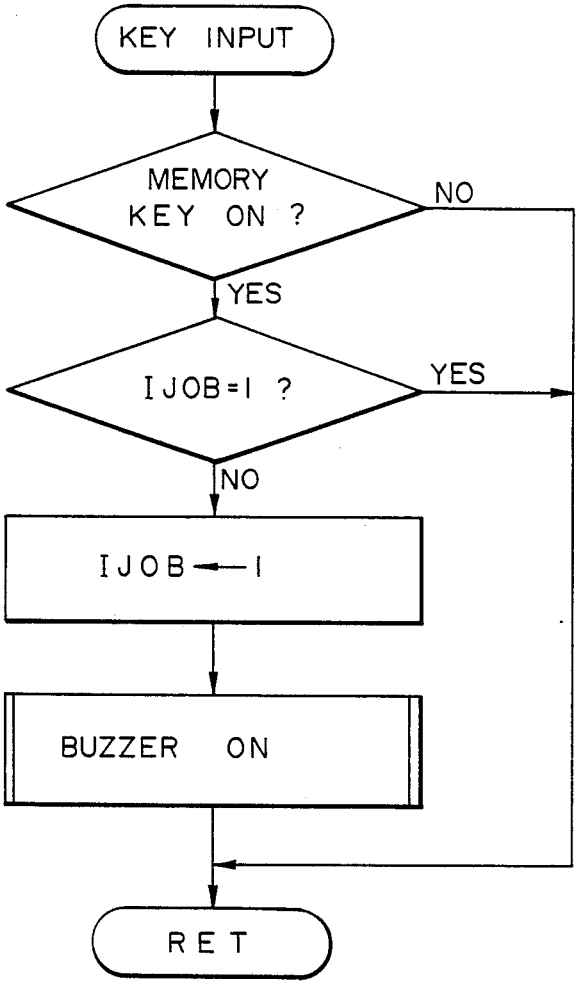

In FIG. 5, when the memory key K5 is turned on, the flag IJOB is checked to see its status. Since the flag IJOB is usually a ZERO, it is set to a ONE and a buzzer is energized for a short period of time. In this manner, the flag IJOB is set to a ONE when the memory key K5 is pressed. In FIG. 4, if the flag IJOB is a ONE at the instant when the memory clear subroutine is to be executed, usual memory clearing is not performed and, instead, the flag IJOB is simply reset to a ZERO to end this subroutine. It follows that when the front cover 18 is opened after the manipulation of the memory key K5 and then closed again, the contents of the individual registers listed in Table 1 are not initialized, i.e., the various modes having been selected before the opening of the cover 18 are regained. It is to be noted that a particular indicator provided on the operation board 30 is turned on when the flag IJOB becomes a ONE.

The embodiment shown and described inhibits mode clearing at the instant of the turn-on of the power supply as desired in response to the manipulation of a special key on the operation board 30, as discussed above. Alternatively, use may be made of a switch which is actuated before the interlock switch 22 when the front cover 18 is opened. Such a switch will cause the flag IJOB to be set automatically when it is actuated, thereby inhibiting mode clearing. This alternative construction inhibits the initialization of modes when the power supply is shut off without resorting the operator's manipulations.

If desired, an arrangement may be made such that the fixing temperature of the copier 10 is sensed at the time of turn-on of the power supply and, if it is lower than a predetermined threshold level, the memory clear subroutine stated above is skipped.

In summary, it will be seen that the present invention provides a mode setting device for office equipment which is capable of inhibiting the initialization of modes ascribable to opening and closing of a front cover of the equipment and thereby eliminating the need for troublesome manipulations otherwise required for setting the modes again after the opening and closing of the cover.

Various modifications will become possible for those skilled in the art after receiving the teachings of the present disclosure without departing from the scope thereof.

What is claimed is:

1. A device for setting operation modes of a machine having a machine body, a housing surrounding said machine body, and an openable cover member forming part of said housing, and driven by a power supply unit, said device comprising:

power supply shut-off means for shutting off at least a part of power supplies of said power source unit when said cover member is opened;

store means for preserving data stored in said store means even when said power supply of said machine is shut off by said power supply shut-off means;

commanding means for commanding preservation of operation modes of said machine; and control means for controlling said power supply unit, said store means and said commanding means;

said control means causing said store means to store operation modes of said machine when said machine is being powered by said power supply unit;

said control means initializing, when a command from said commanding means is absent, the operation modes of said machine after said machine has been powered by said power supply unit;

said control means restoring, when the command from said commanding means is present, said machine to the operation modes stored in said store means after said machine has been powered by said power supply unit.

2. A device as claimed in claim 1, wherein said power supply shut-off means comprises an interlock switch interlocked with opening and closing of said cover member.

3. A device as claimed in claim 1, wherein said store means comprises a non-volatile memory.

4. A device as claimed in claim 1, wherein said store means comprises a random access memory and a back-up means for backing up said random access memory.

5. A device as claimed in claim 1, wherein said commanding means comprises switch means.

6. A device as claimed in claim 1, wherein said control means comprises a microprocessor.

7. A device as claimed in claim 1, wherein said machine comprises an office machine.

8. A device as claimed in claim 7, wherein said office machine comprises an electrophotographic copier.

* * * * *